US005143284A

United States Patent [19]

Socarras

[11] Patent Number: 5,143,284

[45] Date of Patent: Sep. 1, 1992

[54] SECURITY MAILBOX

[76] Inventor: Abelardo Socarras, 1390 W. 38 St., Hialeah, Fla. 33012

[21] Appl. No.: 760,490

[22] Filed: Sep. 16, 1991

[51] Int. Cl.[5] ..... A47G 29/14

[52] U.S. Cl. ..... 232/21; 232/17; 232/24; 232/43.1

[58] Field of Search ..... 232/17, 24, 26, 27, 232/43.1, 43.3, 43.4, 45, 47, 21, 31, 35

[56] References Cited

U.S. PATENT DOCUMENTS

| | | | |
|---|---|---|---|
| 755,038 | 3/1904 | Palmer | 232/24 |
| 1,049,058 | 12/1912 | Davis | 232/45 |
| 1,209,550 | 12/1916 | Buckwalter | 232/45 |
| 2,579,877 | 12/1951 | Stone | 232/27 |
| 2,945,621 | 7/1960 | Kopprasch et al. | 232/24 |
| 4,333,603 | 6/1982 | Carlson | 232/17 |
| 4,361,271 | 11/1982 | Hester et al. | 232/17 |
| 4,753,386 | 6/1988 | Phillion, Sr. | 232/43.1 |
| 4,848,650 | 7/1989 | Roberts, II | 232/43.4 |
| 4,860,910 | 8/1989 | Zipper | 232/43.1 |
| 5,056,711 | 10/1991 | Bush | 232/17 |

*Primary Examiner*—Renee S. Luebke
*Assistant Examiner*—Michael S. Milano
*Attorney, Agent, or Firm*—Malloy, Downey & Malloy

[57] ABSTRACT

A security mailbox, to be used to securely and inconspicuously hold incoming mail while providing an accessible means for a mailman to pick up outgoing mail. The mailbox includes a readily accessible lower compartment and a locked upper compartment, accessible for mail delivery by a flapped opening and having a lockable back door, which are separated and defined by an angled dividing wall that remains substantially hidden when the lower compartment is accessed.

3 Claims, 1 Drawing Sheet

SECURITY MAILBOX

BACKGROUND OF THE INVENTION

1. Field of the Invention

This invention relates to a security mailbox adapted to secretly and inconspicuously store incoming mail while providing an easily accessible mail pick up compartment, thereby providing the user with a convenient and effective means of securing incoming mail and discouraging potential thieves.

2. Description of the Prior Art

Mail theft has become a widespread and growing concern due to the large number of business and financial transactions that take place through the mail. An area of particular concern is with regard to government checks and newly issued credit cards which are of particular value to thieves. As a result of the growing occurrence of mail theft, the United States Postal Services have begun to employ varied added security measures to prevent the theft of mail while it is in transit or on a mail truck. Unfortunately, those security measures have directed thieves to individual mailboxes that are open and easily accessible throughout the day, while most individuals are out or at work.

There have been other attempts in the past to make dual compartment mailboxes having locks thereon, but as the locks are necessarily smaller, they may be easily broken into by most thieves. For this reason, it is necessary to provide a mailbox that may be securely locked, yet give a persistent thief the impression that the mailbox is open and easily accessible, but empty. Applicant's invention is specifically designed for that purpose.

Applicant's invention places the readily accessible and highly visible lower compartment access door at the front of the mailbox, while utilizing an internal, hidden dividing wall to cause mail inserted through a flapped opening, and apparently into the mailbox's single compartment, to slide to the rear portion of the mailbox where it may be accessed only through a locked rear door.

SUMMARY OF THE INVENTION

The present invention is directed towards a security mailbox to be used to securely and inconspicuously hold incoming mail. The security mailbox includes an outer housing having a front wall and a rear wall, which define an interior chamber. The interior chamber is divided into an upper compartment and a lower compartment by a dividing wall which extends from the front wall to the rear wall. The front wall includes a smaller upper opening having a swinging flap positioned in covering, one-way entry relation over the interior side of the opening, thereby allowing mail to be put into the upper compartment, but not taken out. The front wall further includes a larger, hingedly attached door which opens outward to access the lower compartment. The dividing wall which is attached at the front wall between the upper opening and the lower opening is angled downward so as to connect near the lower portion of the rear wall, thereby causing mail placed through the upper opening to slide to the rear of the upper compartment, while remaining substantially hidden from view when the lower compartment is accessed. The rear wall includes a hingedly attached back door, which accesses the upper compartment and has locking means to keep it securely closed. Further included in the security mailbox is a pop up flag to signal the presence of mail within the mailbox, and a handle-type knob positioned on the front door to facilitate opening and closing thereof.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown throughout FIGS. 1-4, the present invention is directed towards a security mailbox generally indicated as 10 to be used to securely and inconspicuously hold incoming mail 60 and provide an accessible location to place outgoing mail.

Figure 1:
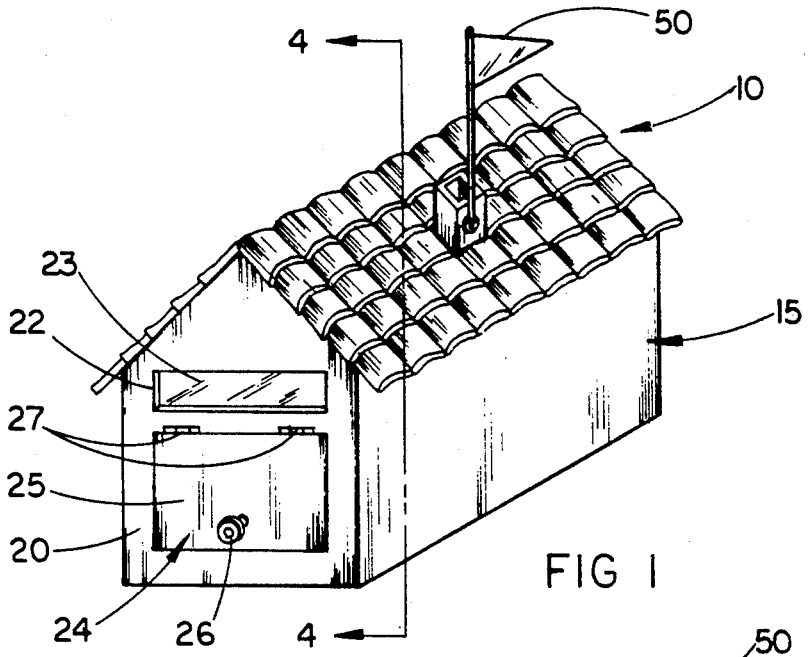
FIG. 1 is a perspective view of the security mailbox.
Figure 2:
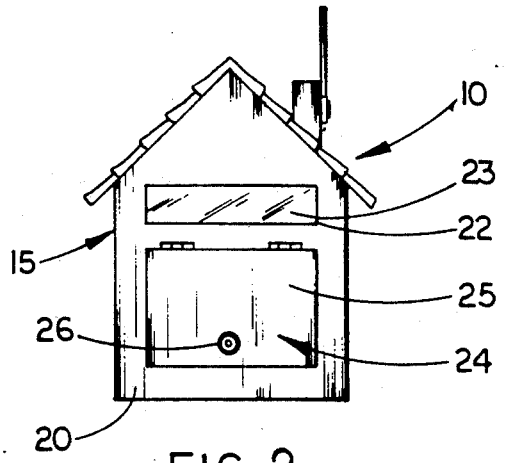
FIG. 2 is a front view of the security mailbox.
Figure 3:
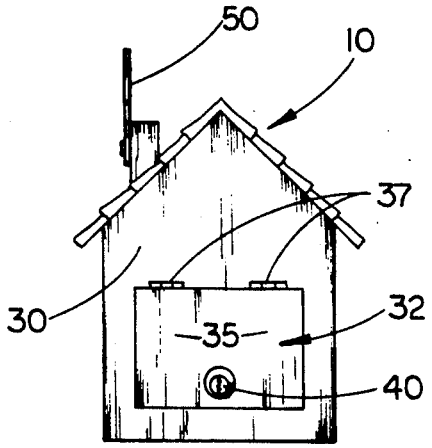
FIG. 3 is a rear view of the security mailbox.

As shown in FIG. 1, the security mailbox 10 looks substantially like a standard mailbox, and includes primarily an outer housing 15. On opposite distal ends of the outer housing 15 are a front wall 20 and a rear wall 30 detailed in FIGS. 2 and 3, respectively. The front wall 20 shown in FIG. 2 includes a smaller upper opening 22 having flap means 23 attached in overlying relation on the rear of the upper opening 22 such that mail 60 may be easily inserted therethrough, but cannot be removed. Further included on the front wall 20 is a larger lower opening 24. The lower opening 24 includes a door 25 which is hingedly attached to the front wall 20 by hinging means 27 and 28, such that it may open outwardly by pulling on the knob handle 26. The back wall 30 shown in FIG. 3 includes a rear opening 32 having a back door 35. The back door 35 includes locking means 40, and is hingedly attached by hinging means 37 to the rear wall 30 such that the back door 35 opens outwardly.

Figure 4:
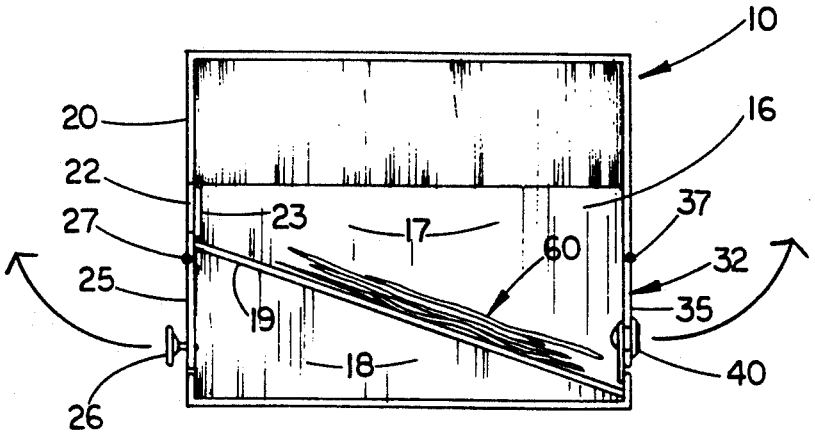
FIG. 4 is a cross-sectional view of the security mailbox along line 4—4 of FIG. 1.

Turning to FIG. 4, the outer housing 15, front wall 20, and rear wall 30 define an interior chamber 16. The interior chamber 16 is divided into an upper compartment 17 and a lower compartment 18 by a dividing wall 19. The lower compartment 18 which is accessed by the lower opening 24 is designed to be readily accessible and may contain outgoing mail to be picked up. The upper compartment 17 is designed to be accessed by the opening 22 wherein incoming mail 60 may be slid, and retrieved through the rear opening 32 by unlocking the locking means 40 and lifting the back door 35. The dividing wall 19 is attached to the front wall between the upper opening 22 and the lower opening 24 and is angled downwardly to attach near the bottom of the rear wall 30, thereby causing incoming mail 60 to slide to the rear of the upper compartment 17. Further, the dividing wall 19 is angled in such a manner that it is not readily visible when the door 25 of the lower opening 24 of the front wall 20 is opened, thereby creating the appearance that there is a single interior chamber 16 which is empty.

The security mailbox 10 further includes a pop up signal flag 50, as shown in FIG. 1, for convenience and decoration.

Now that the invention has been described,

What is claimed is:

1. A security mailbox comprising:

an outer housing including a front wall and a rear wall and an interior chamber, a dividing wall extending from said front wall to said rear wall in said interior chamber, defining an upper compartment and a lower compartment, said front wall including a smaller, upper opening and a lower, larger opening, both extending substantially across a width of said front wall, said upper opening including flap means movably secured in covering relation to said opening such that mail may be slid therethrough into said upper compartment, said flap means including a strip hingedly attached along its upper edge to an upper portion of said upper opening and being normally disposed in covering relation to said upper opening, said strip being structured to be easily pushed inwardly and upwardly to allow mail to be passed therethrough, while falling into covering position over said upper opening after the mail has passed into said upper compartment, said lower opening including a hingedly attached front door structured to be movable between an open and a closed position so as to facilitate access to said lower compartment, said dividing wall attached to said front wall between said upper opening and said lower opening and angled downwardly with an opposite end attached to substantially the bottom of said rear wall, thereby causing mail inserted through said upper opening to slide towards said rear wall, said dividing wall being structured and disposed so as to be substantially hidden from normal view when said front door is open, said rear wall including a rear opening having a hingedly attached back door which opens outwardly to allow access to said upper compartment, locking means for locking said back door in a closed position, and said outer housing further including a signal flag thereon which is movable between a substantially vertically oriented position and a horizontally oriented position.

2. A security mailbox as recited in claim 1 wherein said front door includes a knob on an exterior surface thereof to facilitate opening of said front door.

3. A security mailbox as recited in claim 2 wherein said locking means includes a key operated bolt.

* * * * *